US005857901A

United States Patent [19]

LaPoint

[11] Patent Number: 5,857,901

[45] Date of Patent: Jan. 12, 1999

[54] AUTOMOBILE WHEEL FINISHING APPARATUS

[76] Inventor: Dave A. LaPoint, 6721 Red Coach Dr., Huntington Beach, Calif. 92647

[21] Appl. No.: 795,137

[22] Filed: Feb. 7, 1997

Related U.S. Application Data

[63] Continuation of Ser. No. 565,378, Nov. 30, 1995, abandoned.

[51] Int. Cl.[6] ..... B24B 31/00

[52] U.S. Cl. ..... 451/113; 451/36

[58] Field of Search ..... 451/113, 106, 451/104, 36, 330

[56] References Cited

U.S. PATENT DOCUMENTS

| | | | |
|---|---|---|---|
| 2,425,640 | 8/1947 | Pruitt et al. | 451/36 |
| 2,978,850 | 4/1961 | Gleszer | 451/330 |
| 3,566,552 | 3/1971 | Hambright | 451/36 |
| 3,613,317 | 10/1971 | Kittridge et al. | 451/330 |
| 3,714,770 | 2/1973 | Rothke | 269/20 |

*Primary Examiner*—Robert A. Rose

*Attorney, Agent, or Firm*—Fulwider Patton Lee & Utecht, LLP

[57] ABSTRACT

A wheel finishing apparatus includes an upwardly opening tank which stores therein a water and media mixture. An elongated spindle is mounted on a frame and is displaced directly above the tank. The spindle includes on its lower end a hydraulically expandable bulb which acts as a wheel clamp to releasably mount a wheel to be finished onto the spindle. A circular plate is mounted on the spindle a predetermined distance from the lower end of the spindle and cooperates with a mounted wheel to define a cylindrical flow channel therebetween. A motor connects to the spindle and operates to rotate the spindle and thus the wheel in the media at high speeds.

17 Claims, 2 Drawing Sheets

AUTOMOBILE WHEEL FINISHING APPARATUS

This application is a continuation application Ser. No. 08/565,378 filed on Nov. 30, 1995, now abandoned.

BACKGROUND OF THE INVENTION

1. Field of the Invention

The present invention relates to deburring and finishing apparatus for machined metal parts and, more particularly, to apparatus for finishing automobile wheels.

2. Description of the Prior Art

Stylized chrome wheels have become quite popular with many automobile owners, and in particular with luxury and sports cars. This is due to the fact that chrome wheels serve to substantially enhance the overall appearance of an automobile. Most automobile owners feels that chrome wheels give an automobile a more stylish, sporty and expensive look.

However, order to provide such an aesthetically pleasing appearance, the front or visual face of a machine wheel must made be as smooth as possible before the front face is coated with a layer of chrome. If the front face is not smooth, the chrome layer applied thereto acts to enhance and visually magnify any grooves or imperfections remaining in the wheel surface, thereby significantly detracting from the overall appearance of the wheel. Thus, there is a need for a device which may quickly and efficiently remove substantially all the grooves and roughness on the front face of the wheel to provide a front face with the desired degree of smoothness.

One prior method employed for finishing automobile wheels to polish the front face thereof was to manually finish such wheels by hand. A workman would manually rub an abrasive material against the front face of the wheel which would eventually serve to polish the front face of the wheel. This procedure proved to be quite tedious, time consuming and thus very inefficient.

A mechanical device previously used in the industry to finish automobile wheels is a vibrating finishing machine. Such machines are typically formed with an upwardly opening trough into which is placed an unfinished machined wheel. The wheel is then surrounded with plastic or ceramic media. The machine is then actuated to vibrate the wheel and media such that the continuous agitation of the wheel and media causes the media to contact and rub against the front face of the wheel to eventually finish the wheel. Such a device is not free from shortcomings, however. The process of finishing a wheel in such an apparatus may take up to several hours thus utilizing a substantial amount of machine time. In addition, such an apparatus is quite noisy to operate, which may create a nuisance to any adjacent businesses or residences in addition to transmitting a large amount of noise throughout the building in which it is operated.

Automobile wheels finished by the above-described methods, due to the significant amount of man or machine time involved, are necessarily quite expensive. The finishing costs incurred to prepare the wheel for the chrome plating process significantly raises the costs of the finished wheel. Thus, for many consumers, purchasing stylized chrome wheels is out of the question due to the high cost of such wheels.

It has been proposed to rotate machined parts including machined wheels on a spindle in water containing abrasive media in effort to finish the front face of the wheels.

However, such a procedure has proved to be ineffective in finishing automobile wheels, and has only been found to be effective as a deburrer for deburring the outer edges of certain machined parts, such as gears and the like.

As such, there continues to be a need for a wheel finishing apparatus which is efficient to use and effectively finishes an automobile wheel without requiring a substantial amount of man or machine time, thereby reducing the end cost to consumers. The present invention addresses such needs.

SUMMARY OF THE INVENTION

Briefly, and in general terms, the present invention provides a wheel finishing apparatus which polishes the front face of a machined automobile wheel in a relatively short amount of time. In accordance with the present invention, the apparatus includes an upwardly opening tank which stores therein a water and abrasive media mixture. An elongated spindle is mounted on a frame and is displaced directly above the tank. The spindle includes on its lower end a hydraulically expandable bulb which acts as a wheel clamp to releasably mount a wheel to be finished onto the spindle. A circular plate is mounted on the spindle a predetermined distance from the lower end of the spindle and cooperates with a wheel mounted on the spindle to define a cylindrical flow channel therebetween. A motor connects to the spindle and operates to rotate the spindle and thus the wheel within the media at high speeds. As the spindle is rotated with the mounted wheel submerged in the tank, the wheel and plate cooperate to act as a centrifugal pump to discharge through the flow channel the media and water housed in the chamber formed between the plate and wheel. This serves to draw media toward the front face of the wheel and through the apertures formed on the front face of the typical automobile wheel. As the media is drawn toward the front face of the wheel, it impacts the front face of the wheel to thereby finish the front face of the wheel.

DETAILED DESCRIPTION OF THE PREFERRED EMBODIMENT

Figure 1:
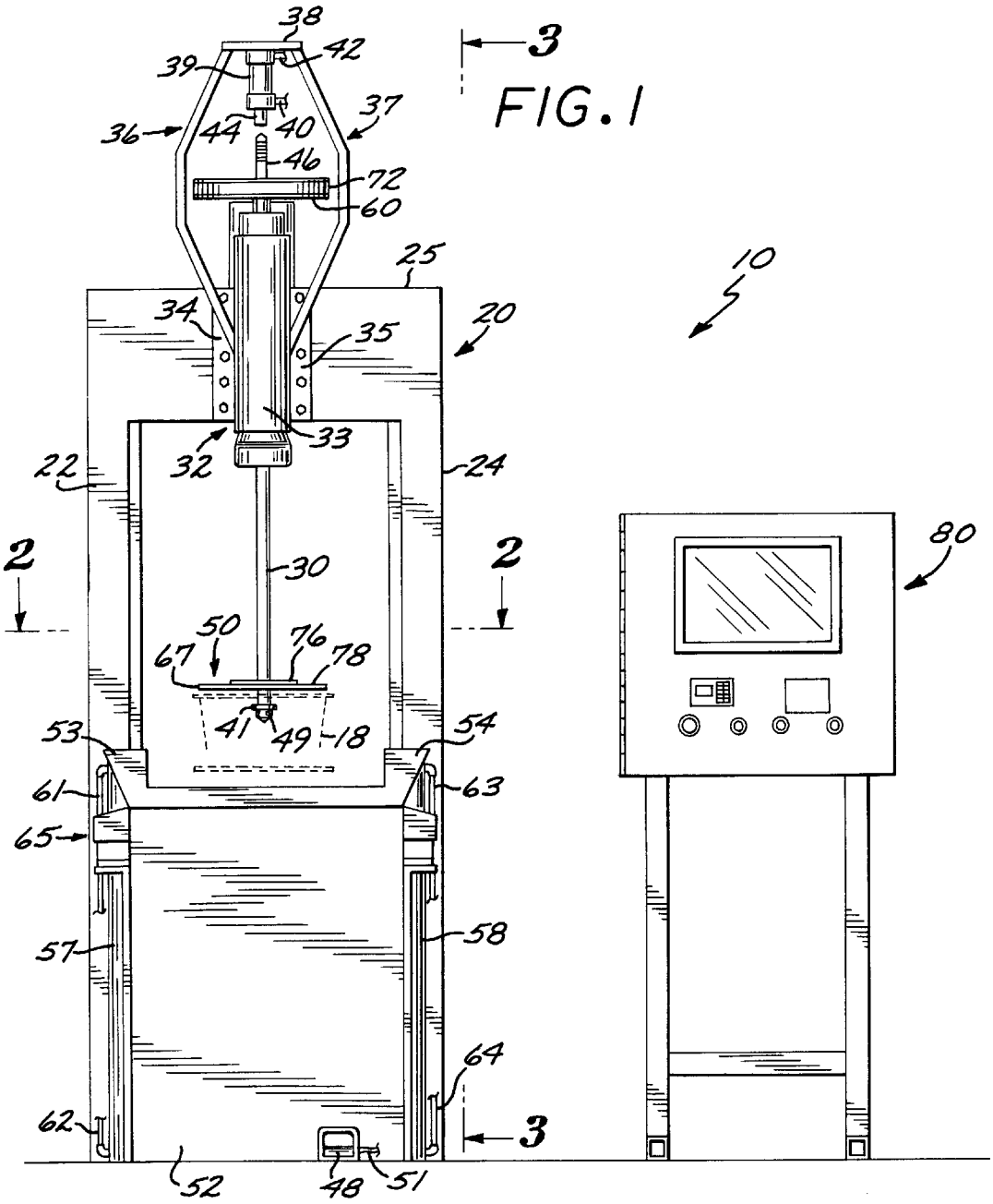
FIG. 1 is a front view of an automobile wheel finishing apparatus embodying the present invention.
Figure 2:
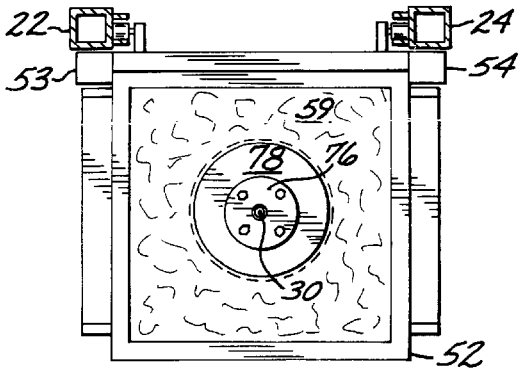
FIG. 2 is a cross-sectional top view taken along the line 2—2 of FIG. 1.
Figure 5:
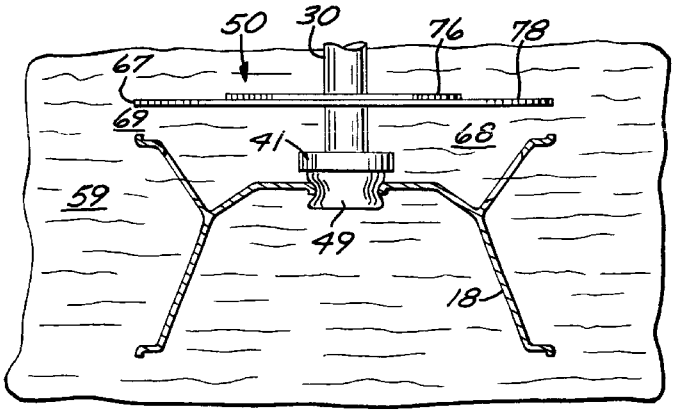
FIG. 5 is a cross-sectional view taken along the line 5—5 of FIG. 4.

In the following detailed description, like reference numerals will be used to refer to like or corresponding elements in the different figures of the drawings. Referring now to the drawings, and particularly to FIG. 1, there is shown an automobile wheel finishing apparatus, generally designated 10, embodying the present invention. The automobile wheel finishing apparatus comprises, generally, a frame 20 which has mounted thereon a rotatable spindle 30. An upwardly opening tank 52 is disposed immediately in front of the frame and directly beneath the spindle and stores therein a water and media mixture 59 (FIGS. 2 and 5). The tank is connected to a hydraulic lift assembly, generally designated 65, which is used for selectively raising and lowering the tank relative to the frame 20 and spindle 30.

Mounted concentrically to the spindle 30 is a circular plate 50, the plate being spaced a predetermined distance from the lower end of the spindle. The spindle 30 further includes at the lower end thereof a wheel clamp 49 for engaging a wheel hub to securely mount a wheel on the spindle. A spindle pulley 60 is fixedly connected to the spindle adjacent the upper end of the spindle 30 such that rotation of the pulley causes a corresponding rotation of the spindle. A motor 70 is mounted to the rear side of the frame and operates to rotate a drive belt 72 which runs on the spindle pulley 60 to thereby rotate the spindle 30.

Figure 3:
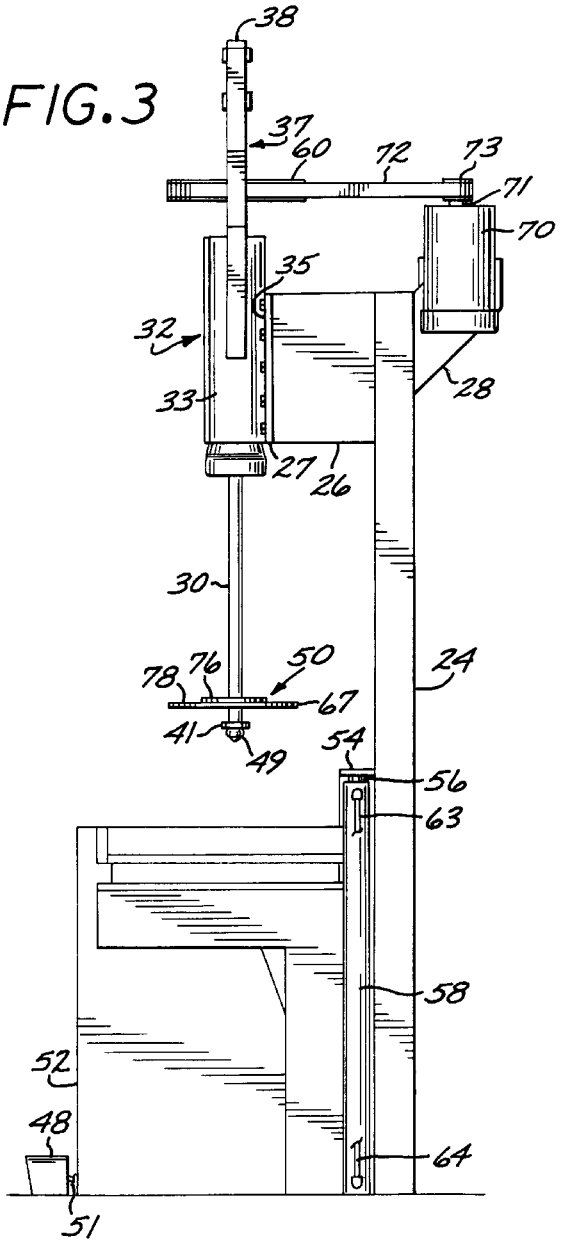
FIG. 3 is a side view of the automobile wheel finishing apparatus taken along the line 3—3 of FIG. 1.

The frame 20 comprises a pair of spaced apart vertical legs 22 and 24. The legs connect at their respective upper ends to the opposite ends of a horizontal cross-member 25. The cross-member includes a forwardly projecting spindle mount 26 which extends from the center of the cross-member and includes a planar front face 27 formed with a plurality of bores arranged in a pair of spaced apart, vertical columns (FIGS. 1 and 3). A motor mount 28 extends from the rear of the cross-member and angles upwardly and rearwardly therefrom in order to properly align the motor 70 with the spindle pulley 60 as described in more detail below. The frame, in the preferred embodiment, is hollow and formed of steel and is approximately ten feet tall.

The spindle 30 comprises a generally cylindrical, elongated hollow rod. A segment of the spindle is housed in and journalled to rotate relative to a spindle housing, generally designated 32. The spindle housing includes a cylindrical casing 33 connected to a pair of out-turned mounting flanges 34 and 35 formed with respective bore patterns corresponding to the bore pattern formed on the spindle mount 26 (FIG. 1). Thus the spindle housing may be securely mounted to the frame 20. Projecting from the opposite sides of the casing are respective mounting arms, generally designated 36 and 37. Such arms project upwardly and outwardly away from the casing, then turn and project upwardly parallel to the axis of the casing and past the spindle pulley 60, and then turn back inwardly to connect with the opposite ends of a horizontal bar 38. Extending downwardly from the center of the bar is a downwardly opening hydraulic piston housing 39 formed with a pair of ports for connection with respective hydraulic tubes 40 and 42. A hydraulic piston 44 is housed in the piston housing and is hydraulically driven to be extended downwardly from the housing as described in greater detail below.

The spindle 30 is formed at its lower end with a wheel clamp 49 comprising a generally spherical, deformable rubber bulb. The bulb may be manipulated to be compressed in a vertical direction along the axis of the spindle and thereby expanded radially outwardly to securely mount a wheel on the spindle as described in greater detail below.

A circular stop 41 is mounted on the spindle 30 directly above the wheel clamp 49. The stop is formed with a diameter larger than that of the central hub bore of a typical wheel to prevent the wheel from being over-extended onto the spindle.

A wheel clamp manipulating shaft 46 is telescopically received in the upper end of the hollow spindle 30 and is spring-loaded to be biased upwardly (not shown). The upper end of the shaft is aligned with and disposed directly beneath the hydraulic piston 44. The shaft makes an air tight fit within the spindle 30 and in its upwardly biased position serves to compress the wheel clamp 49 so that the wheel clamp expands radially outwardly to releasably engage the central hub bore of an automobile wheel to securely mount the wheel on the spindle (FIG. 5).

It will be appreciated that many different forms of attachment means could be provided to releasably, yet securely, mount the wheel 18 on the spindle 30. For example, and not by way of limitation, a plate including a plurality of downwardly extending studs could be mounted on the spindle beneath the circular plate 50, the studs being arranged in a pattern to correspond with the bore pattern formed on the wheel center. Thus the studs could be extended through such bores and threaded nuts threadably engaged therewith to securely mount the wheel on the spindle. In addition, the spindle could be formed with a threaded lower end, such that with the spindle extended through the central hub bore formed on the wheel, an enlarged in diameter threaded cap could be engaged with the threaded end of the spindle to thereby hold the wheel in place.

An activation pedal 48 is provided and is disposed in front of the tank 52. The pedal 48 is in hydraulic communication with hydraulic tubes 40 and 42, which operate the piston 44, via connecting hydraulic tube 51. The actual connection of tubes 40, 42 and 51 is not shown. However, such tubing connections are well known to those skilled in the art. In operation depression of the pedal 48 acts to hydraulically drive the piston 44 to a downwardly extended position from the piston housing 39 to engage and drive the shaft 46 downwardly. Such downward displacement of the shaft acts to release the wheel clamp 49 so that it returns to its normal, generally spherical configuration to release the wheel 18.

Figure 4:
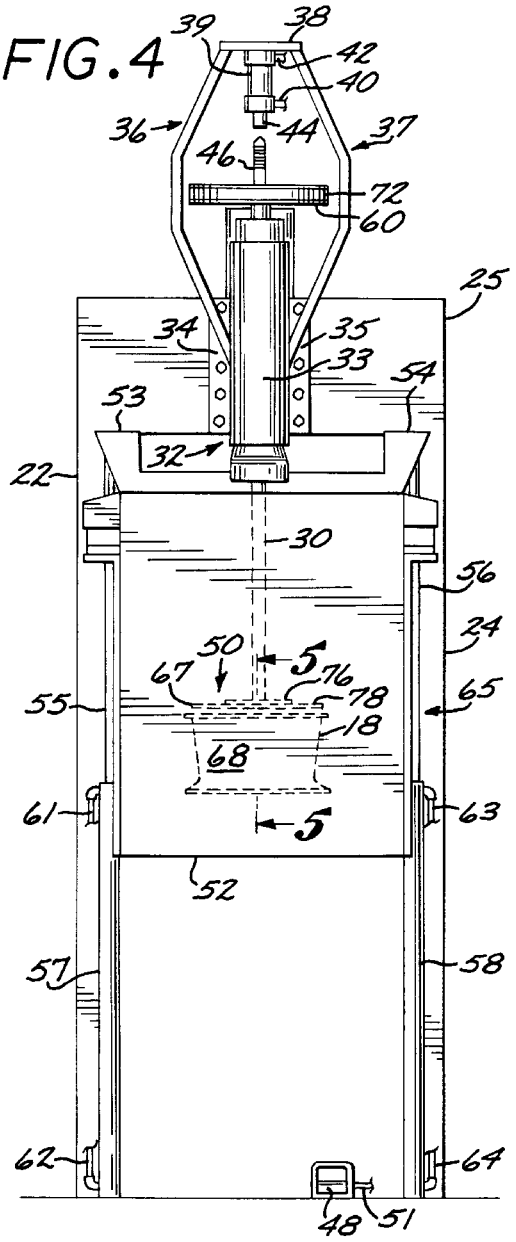
FIG. 4 is a front view similar to FIG. 1 but showing the tank elevated relative to the frame.

The tank 52 comprises a generally cubical, upwardly opening tank. Connected to the upper end of the tank and disposed at opposite rear sides thereof are a pair of ears 53 and 54. The ears connect to the upper ends of respective hydraulically driven telescoped arms 55 and 56 of the hydraulic lift assembly 65 (FIG. 4). The telescoped arms are received in respective upwardly opening sleeves 57 and 58. A plurality of hydraulic tubes 61, 62, 63 and 64 connect to the respective sleeves to provide hydraulic means for extending the arms upwardly from the sleeves to thereby elevate the tank 52.

The plate, generally designated 50, comprises a pair of circular discs 76 and 78 having different diameters. In the preferred embodiment, the larger of the two discs 78 has a diameter substantially equal to that of the mounted wheel to be finished. The respective discs are fixedly connected to each other by means of a plurality of bolts (not shown) which extend through bores formed in the discs for engagement with respective nuts to securely join the discs.

The plate 50 is fixedly mounted on the spindle 30 a predetermined distance from the lower end of the spindle. With the wheel 18 mounted on the spindle 30, a cylindrical flow channel 69 is created between the plate 50 and the upper peripheral edge 67 of the wheel. The optimum spacing between the plate 50 and wheel 18 is based primarily upon the style and size of the wheel to be finished. I have found through extensive experimentation that for relatively thick wheels, a relatively large gap or spacing provides the best results. For wheels which are about twenty inches deep, the distance between the upper peripheral edge 67 of the wheel and the plate 50 should be approximately six inches. For more standard wheels which are from ten to fourteen inches deep, a gap or spacing of about two to three inches typically gives the best results. The width of the gap may vary slightly depending upon the particular aperture pattern of the wheel 18 to be finished.

In addition, for wheels with relatively large diameters, i.e. 18 inches or greater, a relatively large gap on the order of six inches will usually give the best results. This is due to the large volume of mixture 59 which is initially disposed in the chamber 68. As the wheel is rotated in the mixture 59, the amount of mixture 59 exiting through the gap 69 will be relatively large. Thus a relatively large gap may be used, and the rotating plate 50 and wheel 18 will still function as a centrifugal pump.

In the preferred embodiment, the plate 50 is formed having a diameter substantially equal to that of the wheel 18 to be finished. In order to function properly, the plate 50 should have a diameter nearly equal to that of the wheel 18 or have a diameter larger than the diameter of the wheel to be finished. As discussed in greater detail below, one of the primary functions of the plate 50 is to block water and media mixture 59 disposed above the wheel 18 from flowing downwardly into the chamber 68 formed between the plate 50 and wheel 18. Thus, although the exact diameter of the plate 50 is not critical to the invention, the diameter should approximate the diameter of the wheel or be larger than the diameter of the wheel in order to block the flow of water and media downwardly into the chamber 68. In addition, the cylindrical gap 69 formed between the periphery of the plate 50 and the upper peripheral edge 67 of the wheel 18, as discussed above, is an important feature of the present invention. Thus, in order to form the cylindrical gap 69 the diameter of the plate 50 must approximate or exceed the diameter of the wheel 18.

The plate 50, in the preferred embodiment, comprises the pair of discs 76 and 78. The plate 50 could, of course, be formed by a single circular disc having a diameter approximating that of the wheel 18 and mounted in a peripheral groove formed on the spindle 30.

The thickness of the plate 50 is not critical to the invention, so long as the plate 50 is formed of a suitable material which is sufficiently sturdy to withstand the forces created when the spindle 30 rotates at 300 to 400 R.P.M. In the preferred embodiment, the discs 76 and 78 are formed of steel and are approximately ½ inch thick.

The spindle motor 70, in the preferred embodiment, comprises a reversible, 30 horsepower AC or DC electric motor. The motor drives a rotatable shaft 71 which connects at its distal end to a drive pulley 73. With the motor connected to the upwardly and rearwardly projecting motor mount 28, the drive pulley and spindle pulley 60 will be automatically aligned in a common horizontal plane. Thus the drive belt 72 may run on both such pulleys so that rotation of the drive pulley will be translated into rotation of the spindle pulley and thus the spindle 30 itself.

A programmed logic controller 80 (PLC), as is well known in the art, is included and acts to control the hydraulic lift assembly 65 and spindle motor 70. An on-off button is included and may be pressed to actuate the PLC to commence the automobile wheel finishing process. In the preferred embodiment, the PLC is programmed to step up the tank as the rotating wheel 18 is submerged in the tank. It has been found that placing a stationary wheel in the water and media mixture 59 and then attempting to rotate the wheel often serves to overload the motor 70 such that the motor stalls. Thus the PLC activates the hydraulic lift assembly 65 to begin elevating the tank 52, and simultaneously activates the motor 70 to begin rotating the spindle 30 and thus the mounted wheel 18. As the wheel 18 begins to be submerged in the water and media mixture 59, the PLC temporarily deactivates the hydraulic lift assembly 65 so that the resistance to rotation from the mixture 59 may be incrementally overcome by the motor 70. Once the wheel 18 is completely submerged in the mixture 59, the PLC is programmed to rotate the wheel in one direction for 2–7 minutes, depending on the construction of the wheel to be finished, and then rotate the wheel in the opposite direction for the same amount of time.

In the preferred embodiment, the wheel 18 is rotated in the water and media mixture 59 at speeds approximating 300–400 R.P.M. During rotation plate 50 and peripheral wheel edge 67 cooperate to function as a centrifugal pump. When the wheel and plate are initially submerged in the mixture, water and media will collect in the chamber 68 formed between the lower face of the plate and the wheel center. As the wheel and plate are rotated, the mixture contained within the chamber 68 will be driven by centrifugal force outwardly and through the cylindrical flow channel 69. Such evacuation of mixture from the chamber acts to create a vacuum within the chamber tending to draw additional mixture into the chamber 68. In this regard, the plate serves a second function in addition to cooperating with the wheel to act as a centrifugal pump. With the plate 50 positioned above the wheel, the plate acts to block the flow of mixture disposed above the wheel downwardly into the chamber 68. Thus, mixture will necessarily be drawn into the chamber 68 from beneath the wheel and through the apertures formed on the front face of the wheel center. As the water and media mixture is drawn toward the front face of the wheel, some of the media will contact and rub against the front face of the wheel center. Such continuous, high speed abrasion between the media and front face of the wheel center serves to efficiently and relatively quickly polish the front face of the wheel center to thereby finish the wheel.

While in the preferred embodiment the tank 52 is elevated by means of the hydraulic lift assembly 65, it will be appreciated that many different means for submerging the wheel 18 in the tank may be employed. For example, an electric motor could be employed to selectively raise and lower the tank. In addition, the vertical legs 22 and 24 of the frame 20 could be telescoped and a hydraulic lift assembly connected thereto to allow for lowering the frame relative to the tank to thereby submerge the mounted wheel in the tank.

In the preferred embodiment the media are in the form of cones and made of plastic and are in the form of pyramids or cones and are between ½ and ¾" in size. Such media are available from the Almoc Company of Gardena, Calif.

In the preferred embodiment, the apparatus of the present invention includes one spindle which mounts therefrom one wheel so that the apparatus may finish one wheel at a time. However, it will be appreciated that the apparatus could include a frame formed for mounting multiple spindles spaced apart a predetermined distance and driven by a single spindle motor. As such the apparatus would allow for finishing multiple wheels simultaneously, thereby further enhancing the efficiency of the present invention.

In use, an operator may depress the activation pedal 48 to extend the hydraulic piston 44 downwardly from the piston housing 39 to engage and force the shaft 46 downwardly through the spindle 30 to release the wheel clamp 49. As such the wheel 18 to be finished may be placed beneath the lower end of the spindle 30 to align the spindle with the central hub bore formed on the wheel. The wheel may then be raised such that the wheel clamp and a portion of the spindle extend through the central hub bore. The operator may then release the pedal so that the hydraulic piston is retracted back into the piston housing. Thus the upwardly biased shaft 46 will return to its normal position which results in the wheel clamp being squashed as is shown in FIG. 5. As such, the wheel clamp will securely hold the wheel in place.

The operator may then press the on-off button on the PLC to activate same. In operation the PLC activates the hydraulic lift assembly 65 and the spindle motor 70. The tank 52 is thereby elevated by the hydraulic lift assembly and the spindle begins to rotate. As the wheel begins to be submerged in the tank, the PLC acts to raise the tank in predetermined stepped increments. After each such increment, the lifting sequence is temporarily stopped to cease the continued elevation of the tank. This keeps the load on the motor 70 within allowable limits so that the motor may rotate the wheel 18 up to speeds approximating 300 to 400 R.P.M. without stalling the motor 70. After a brief interruption in the lifting or elevation of the tank (less than one second), the PLC then reactivates the hydraulic lift assembly to elevate the tank another increment. This process is repeated until the wheel is completely submerged in the tank.

Once the tank 52 is fully elevated such that the wheel 18 is completely submerged in the tank, the PLC controls the motor 70 to rotate the wheel in one direction for a predetermined amount of time, which is typically on the order of two to seven minutes, depending upon the style of wheel to be finished. After the predetermined amount of time has elapsed, the PLC sends a control signal to the motor to manipulate the motor to rotate in the opposite direction for the same amount of time.

After the wheel has been rotated in both directions, the PLC sends a control signal to the motor 70 to deactivate the motor. The PLC also causes the hydraulic lift assembly 65 to lower the tank 52 thereby withdrawing the wheel 18 from the tank. The operator may once again depress the pedal 48 to release the wheel clamp 49. The finished wheel is then released and may be removed from the spindle 30. The front or visual face of the wheel be smooth and thus ready for chrome plating. The automobile wheel finishing apparatus is then available to finish another wheel.

From the foregoing, it will be appreciated that the automobile wheel finishing apparatus of the present invention is easy to use, requires minimal man hours and operator supervision, and efficiently and relatively quickly finishes an automobile wheel.

While a particular form of the present invention has been illustrated and described, it will also be apparent that various modifications can be made without departing from the spirit and scope of the invention. Accordingly, it is not intended that the invention be limited, except as by the appended claims.

What is claimed is:

1. A wheel finishing apparatus for finishing a wheel including a front face formed with a plurality of openings, said apparatus comprising:

a frame;

a tank for storing an abrasive media therein and having an open end;

a spindle rotatably connected to said frame, said spindle having first and second ends;

means for mounting a wheel on said first end of said spindle;

a plate mounted concentrically on said spindle a predetermined distance from said first end, said plate having a predetermined configuration to define an annular flow path between said plate and wheel to, when said plate and wheel are rotated in said abrasive media, define a pump means to expel said media radially through said annular flow path and therefor draw additional said media toward said openings in said wheel;

means for placing said tank and said first end of said spindle relative to each other for positioning said wheel and plate within said tank; and drive means connected to said spindle for rotating said spindle to cause said plate and wheel to rotate in said tank to finish said wheel, whereby when said wheel is mounted on said spindle and said wheel and plate are disposed in said tank, an amount of said media is trapped between said wheel and plate such that when said spindle rotated, said wheel and plate cooperate to define said pump means to expel said trapped media radially outwardly through said annular flow path and draw said media toward said openings in said wheel to contact said front face of said wheel to finish said front face.

2. The apparatus of claim 1 further including:

a programmed logic controller for controlling said drive means and said displacing means.

3. The apparatus of claim 1 wherein:

said drive means comprises an electric motor.

4. The apparatus of claim 1 further including:

a pulley mounted on said spindle adjacent said second end and wherein:

said drive means includes a drive belt which runs on said pulley to rotate said spindle.

5. The apparatus of claim 1 wherein:

said first end of said spindle includes an expandable engagement bulb for releasably engaging and holding said wheel on said spindle.

6. The apparatus of claim 1 wherein:

said displacement means comprises a hydraulically actuated lift connected to said tank for elevating said tank with respect to said spindle.

7. The apparatus of claim 1 wherein:

said plate is mounted on said spindle in a predetermined position so that said wheel and said plate are spaced between one half to six inches apart.

8. The apparatus of claim 5 further including:

means for selectively activating said expandable engagement bulb.

9. A wheel finishing apparatus for finishing a wheel including a front face formed with a central opening and a plurality of spaced apart openings, said apparatus comprising:

a frame;

an upwardly opening tank for storing an abrasive media therein;

an elongated, vertically oriented spindle rotatably connected to said frame and having upper and lower ends;

means for releasably mounting a wheel on said lower end by engaging said central opening of said wheel, said lower end being disposed directly above said tank;

a circular plate having a diameter substantially equal to the diameter of said wheel and concentrically mounted on said spindle a predetermined distance above said lower end so that when said wheel is mounted on said spindle, said wheel and plate create a annular flow path therebetween when said wheel and plate are rotated in said tank storing said abrasive media to expel said media trapped between said wheel and plate radially outwardly through said annular flow path to thereby draw additional of said media through said openings in said wheel;

means for placing of said tank and said first end of said spindle relative to each other for positioning said wheel and plate within said tank; and a motor connected to said spindle for rotating said spindle to rotate said plate and wheel in said tank to finish said wheel.

10. The apparatus of claim 9 further including:

a programmed logic controller for controlling said motor and said displacing means.

11. The apparatus of claim 9 wherein:

said motor comprises an electric motor.

12. The apparatus of claim 9 further including:

a pulley mounted on said spindle adjacent said second end and wherein:

said motor includes a drive belt which runs on said pulley to rotate said spindle.

13. The apparatus of claim 9 wherein:

said first end of said spindle includes an expandable engagement bulb for releasably mounting said wheel on said spindle.

14. The apparatus of claim 9 wherein said means for displacing comprises:

a hydraulically actuated lift connected to said tank for elevating said tank with respect to said spindle.

15. The apparatus of claim 9 wherein:

said plate is mounted on said spindle in a predetermined position so that said plate and wheel are spaced between one half and six inches apart.

16. The apparatus of claim 13 further including:

means for selectively activating said expandable engagement bulb.

17. A method of finishing an automobile wheel including a front face formed with a plurality of openings, said method comprising the steps of:

selecting an automobile wheel finishing apparatus including a frame, a tank having an open end, a spindle connected to said frame and formed for mounting a wheel thereon, a plate mounted concentrically on said spindle a predetermined distance from said first end and having predetermined dimensions to define an annular flow path between said plate and wheel and to define a centrifugal pump means when said wheel and plate are rotated in a media mixture, and drive means connected to said spindle for rotating said spindle;

filling said tank with a mixture of water and an abrasive media;

mounting said wheel on said spindle;

placing said wheel and plate within said mixture; and actuating said drive means to rotate said spindle in said mixture such that said wheel and plate cooperate to define said centrifugal pump means to expel said water and media radially outwardly through said annular flow path and thereby draw said media toward said front face of said wheel and through said openings in said front face to finish said wheel.

* * * * *

UNITED STATES PATENT AND TRADEMARK OFFICE

CERTIFICATE OF CORRECTION

PATENT NO. : 5,857,901
DATED : January 12, 1999
INVENTOR(S) : Dave LaPoint

It is certified that error appears in the above-identified patent and that said Letters Patent is hereby corrected as shown below:

Column 8,
Line 18, replace “displacing” with -- placing --.
Line 31, replace “displacement” with -- placing --.
Line 58, replace “a” with -- an --.
Line 65, replace “first” with -- lower --.

Column 9,
Line 6, replace “displacing” with -- placing --.
Line 10, replace “second” with -- upper --.
Line 16, replace “first” with -- lower --.
Line 20, replace “displacing” with -- placing --.

Signed and Sealed this

Thirtieth Day of July, 2002

*Attest:*

*Attesting Officer*

JAMES E. ROGAN
*Director of the United States Patent and Trademark Office*